US007171713B1

(12) United States Patent
Raley

(10) Patent No.: US 7,171,713 B1
(45) Date of Patent: Feb. 6, 2007

(54) MULTI-TOOL FOR USE WITH GOLF CARTS

(76) Inventor: Jesse D. Raley, 107 White River Ct., Bull Shoals, AR (US) 72619

( * ) Notice: Subject to any disclaimer, the term of this patent is extended or adjusted under 35 U.S.C. 154(b) by 88 days.

(21) Appl. No.: 11/010,672

(22) Filed: Dec. 13, 2004

(51) Int. Cl.
*B25F 1/00* (2006.01)

(52) U.S. Cl. ..... 7/169; 7/170; 15/105

(58) Field of Classification Search ..... 7/169, 7/170; 15/236.08, 237, 105, 245, 246; 280/DIG. 5, 280/727, 855; 74/495
See application file for complete search history.

(56) References Cited

U.S. PATENT DOCUMENTS

| | | | | | |
|---|---|---|---|---|---|
| D53,161 | S | * | 4/1919 | Vicario | D8/17 |
| D141,321 | S | * | 5/1945 | Gallagher | D8/17 |
| 2,980,936 | A | * | 4/1961 | Snow et al. | 15/113 |
| 3,208,542 | A | * | 9/1965 | Fischer | 175/403 |
| 3,310,826 | A | * | 3/1967 | Ellis | 15/105 |
| 3,968,535 | A | * | 7/1976 | Nichols, Jr. | 15/105 |
| 4,281,433 | A | * | 8/1981 | Sendoykas | 15/105 |
| 5,003,656 | A | * | 4/1991 | Loppnow | 7/169 |
| 5,007,129 | A | * | 4/1991 | Hainey | 15/236.08 |
| 5,020,181 | A | * | 6/1991 | Leonard | 15/105 |
| 5,121,519 | A | * | 6/1992 | Haugom | 15/105 |
| 5,228,159 | A | * | 7/1993 | Gurka | 7/105 |
| 5,251,351 | A | * | 10/1993 | Klotz | 7/100 |
| D356,892 | S | * | 4/1995 | Ricci | D4/116 |
| 5,489,121 | A | * | 2/1996 | Mohr | 281/43 |
| 5,507,052 | A | * | 4/1996 | Smith et al. | 7/151 |
| 5,870,794 | A | * | 2/1999 | Harpell | 15/105 |
| 5,937,473 | A | * | 8/1999 | Lisowski | 15/236.08 |
| 5,997,411 | A | * | 12/1999 | Holub | 473/282 |
| 6,314,632 | B1 | * | 11/2001 | Athan et al. | 29/426.5 |
| 6,640,369 | B1 | * | 11/2003 | Malvasio | 7/105 |
| 6,994,639 | B2 | * | 2/2006 | Parks et al. | 473/408 |
| 2004/0113397 | A1 | * | 6/2004 | Lecoq | 280/727 |
| 2006/0037159 | A1 | * | 2/2006 | Wang | 15/144.1 |

* cited by examiner

*Primary Examiner*—D. S. Meislin
(74) *Attorney, Agent, or Firm*—Thomte, Mazour & Niebergall; Shane M. Niebergall

(57) ABSTRACT

A multi-purpose golfing tool is provided with an elongated body having an arm that extends angularly from one end of the body to releasably engage the rearward portion of a golf cart seat. The opposite end is provided with a feature for engaging the steering wheel, enabling a user to tilt the seat forward and prop the seat in an open position. Projections on the arm member are provided to clean debris from the sole of a golf shoe. A flexible blade is provided along a length of the body for removing fluid and debris from surfaces of the golf cart. The tool conveniently secures to the steering column for storage.

16 Claims, 3 Drawing Sheets

MULTI-TOOL FOR USE WITH GOLF CARTS

BACKGROUND OF THE INVENTION

1. Field of the Invention

The present invention relates to tools used by golfers and more particularly to a multi-use tool that can be used to temporarily retain the engine compartment cover of a golf cart in an open position, remove debris from the soles of golf shoes, and remove liquid cleaning supplies and other fluids from various surfaces of a golf cart.

2. Description of the Prior Art

Many modern golf carts are provided with engines and ancillary equipment, such as batteries, within an engine compartment that is positioned at least partially beneath the bench seat of the golf cart. Access is provided to the engine compartment by tilting the bottom portion of the golf seat in a forward position, toward the steering wheel, exposing the engine compartment opening. While this arrangement provides quick and easy access to the engine compartment, there are no standard structural features associated with the engine compartment or the seat that keep the seat in an open position. Traditionally, golfers may wedge a stick or other elongated object between the seat and the engine compartment. However, the sticks and other such devices usually slip out of engagement with either the seat or the engine compartment, allowing the seat to fall back toward its closed position. Many times, this occurs while the users head or arm are positioned between the seat and the opening of the engine compartment. Such support devices are further problematic in that they are typically stored loosely within the engine compartment, which permits the support devices to become accidentally engaged with moving components on the engine in a manner that risks damage to the engine. In those instances where the seat isn't propped open, the user oftentimes must remove the seat entirely from the golf cart.

Another problem encountered by golfers during a round of golf is the accumulation of grass clippings, mud or other debris on the sole of their golfing shoes. When the accumulated debris is discovered, most golfers typically search through the golf cart, their bag, or their immediate surroundings for an object that can be used to effectively remove the debris from their shoes. Oftentimes, no such objects can be located, or when an object can be found it is typically ineffective for cleaning the shoe.

Yet another problem encountered by golfers is the accumulation of dirt or other unwanted debris on various surfaces of the golf cart. If the golfers are lucky, they may be near a source of water or cleaning fluids to loosen or remove the debris. However, the golfers are not always prepared with a device for removing the cleaning fluid, water or liquid debris from the various surfaces of the golf cart. Leaving these fluids on the surfaces of the golf cart typically leaves water spots or unsightly stains or marks. When the golf cart has a windshield, such water spots and marks can obscure the golfers' vision.

While a plurality of different devices may be used by golfers to remedy these various problems, it is inconvenient to have to purchase and store several different devices on a golf cart during a round of golf. While the golfers could put several devices within their golf bags, such space is typically limited and, oftentimes, items stored within golf bags are "out of sight and out of mind" and unused. Other storage space on a golf cart is limited and may become inconvenient to use for those who don't own the golf cart. Accordingly, what is needed a single tool that performs a plurality of different needed functions on or around a golf cart. However, such a tool should be able to be conveniently stored on the golf cart for easy access.

SUMMARY OF THE INVENTION

The multi-tool of the present invention is generally provided with an elongated body having first and second end portions. An arm member extends from the first end portion of the body in an angular fashion. The second end portion of the tool is provided with a means for releasably engaging a portion of a golf cart steering wheel. This general configuration permits a user to secure a golf cart seat in an open position above the engine compartment by engaging one end of the arm member with a rearward edge portion of the seat and engaging the second end portion of the tool with the steering wheel. In one embodiment, generally pointed projections extend from a distal end portion of the arm member. In use, a golfer may grasp the body of the tool and engage the projections with debris that has accumulated on the golfer's shoes in a repeated fashion until the debris has been removed satisfactorily.

In one embodiment of the present invention, the tool is provided with an elongated blade that extends from and along a length of the tool body. The blade is comprised of a resiliently deformable material that permits a user to engage the blade with any wet surface on the golf cart and manipulate the blade across the wet surface to substantially remove the unwanted fluid.

One embodiment of the tool of the present invention provides a securement means, such as a flexible strap or bracket that is secured to the body of the tool and enables the tool to be easily stored adjacent the steering column or other elongated structural member found on the golf cart.

It is therefore a principle object of the present invention to provide a multi-purpose tool for use with and around golf carts.

It is a further object of the present invention to provide a multi-purpose golfing tool that releasably secures a golf cart seat in an open position so that a user may safely access the engine compartment without the seat falling into a closed position.

Still another object of the present invention is to provide a multi-purpose golfing tool that can be used by golfers to remove debris that has accumulated on the soles of their golfing shoes.

Yet another object of the present invention is to provide a multi-purpose golfing tool that may be used to substantially remove fluids from various surfaces of a golf cart.

Still another object of the present invention is to provide a multi-purpose golfing tool that may be quickly and conveniently secured to the steering column of a golf cart to store the tool in a readily accessible.

Yet another object of the present invention is to provide a multi-purpose golfing tool that may be used to secure the seat of a golf cart in an open position, remove debris from the soles of golfers shoes, and substantially remove fluid from various surfaces of a golf cart.

These and other objects of the present invention will be apparent to those skilled in the art.

DESCRIPTION OF THE PREFERRED EMBODIMENT

In the following detailed description of exemplary embodiments, references are made to accompanying FIGS. 1–4, which form a part hereof and illustrate exemplary embodiments that may be implemented in order to practice the present invention. These embodiments are disclosed in sufficient detail to enable those skilled in the art to practice the invention. It should be understood, however, that other embodiments may be utilized and changes may be made to the illustrated embodiments without departing from the spirit or scope of the present invention. The following detailed descriptions are, therefore, not to be taken in a limiting sense and the scope of the present invention is defined only by the appended claims.

Figure 1:
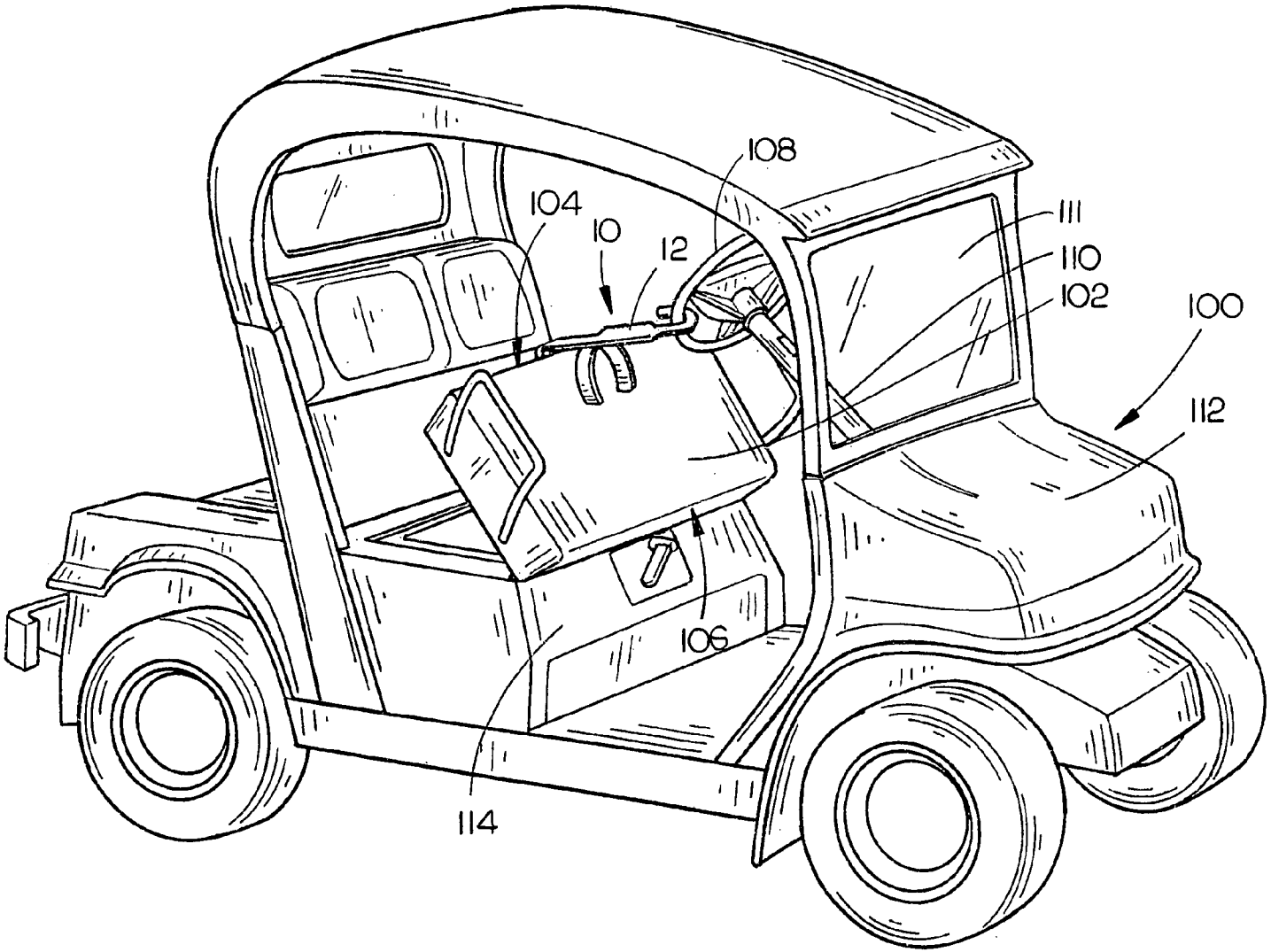
FIG. 1 is an isometric view of the tool of the present invention, demonstrating one possible use of the tool with a golf cart.
Figure 2:
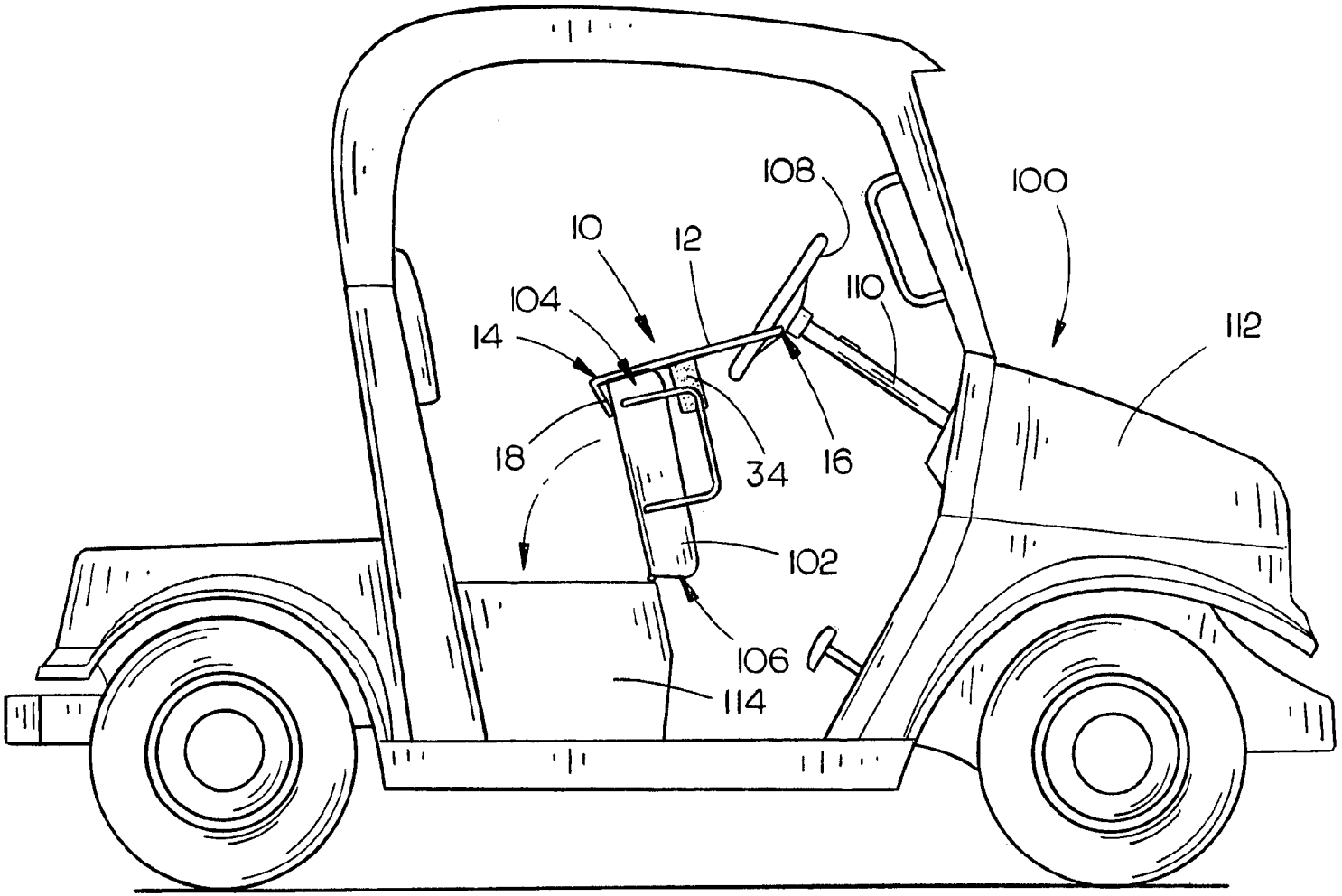
FIG. 2 is a side elevation view of the tool and golf cart depicted in FIG. 1.

FIG. 1 is a perspective view of the multi-purpose tool 10 of the present invention and depicts one manner in which it could be used with a golf cart 100. The tool 10 is generally provided with an elongated body 12 having a first end portion 14 and an opposite second end portion 16. An arm member 18 is provided at the first end portion 14 and extends outwardly from the body 12. It is preferred that the arm member 18 extend angularly from the body 12 so that it is generally perpendicularly disposed thereto. However, it is contemplated that, depending upon the intended use and the variable nature of the circumstances, the arm member 18 could be provided to extend at an acute or obtuse angle from the body 12. In a preferred embodiment, the second end portion 16 is provided with a means for releasably securing the second end portion 16 of the body 12 to a portion of the golf cart steering wheel 108. In one embodiment, the means is simply provided by a hook-shaped member 20 that is provided with a shape and size to selectively and releasably receive at least a portion of the steering wheel 108, as depicted in FIGS. 1 and 2. The orientation of the hook-shaped member 20 should be provided according to the intended use of the tool 10 and may not be limited to the orientation as depicted in the accompanying Figures. Other means may be used to secure the second end portion 16 with the steering wheel 108, such as an elongated, flexible strap or cord (not pictured) that could be coupled with the steering wheel 108 and then secured to itself or to a fastening device (such as a hook-and-eye, snap, hook-and-loop or other similar fastener closely adjacent the steering wheel 108). Other similar means are contemplated as well as a combination of the flexible strap or cord with a generally rigid, hook-shaped member disposed on a distal end thereof.

As depicted in FIGS. 1 and 2, the tool 10 may be used to secure the golf cart seat 102 in an open position. Where the golf cart seat 102 is pivotably coupled at its forward end portion 106 to the engine compartment 114, the seat may be selectively moved between an open position (as depicted) and a closed position, which places the seat 102 in a generally horizontal fashion closely adjacent the engine compartment 114. In its open position, the seat 102 may be secured in place by positioning the arm member 18 closely adjacent the rearward end portion 104 of the seat 102 and releasably coupling the second portion 16 of the body 12 with the steering wheel 108. In this manner, the seat 102 will be prevented from unintentionally moving to its closed position while the user is servicing the golf cart engine or its ancillary components. Where the structural integrity of the arm member 18 is in question, due to the weight of the seat 102 or the materials from which the tool 10 is formed, a reinforcement rib 22 may be provided to strengthen the connection between the body 12 and the arm member 18, as depicted in FIG. 3.

In a preferred embodiment, the distal end portion 24 of the arm member 18 is provided with one or more generally pointed projections 26. With this additional structural detail, a user may grasp the body portion 12 and engage the projections 26 with debris, such as grass clippings, mud and the like, from the soles of his or her golfing shoes. Accordingly, the size and shape of the projections 26 should be provided in a manner that easily engages and dislodges such debris with relative ease without marring the sole of the golfing shoe. Simple manipulation of the tool in various directions across and against the sole of the shoes will typically remove a substantial portion of any debris commonly encountered while golfing.

Figure 3:
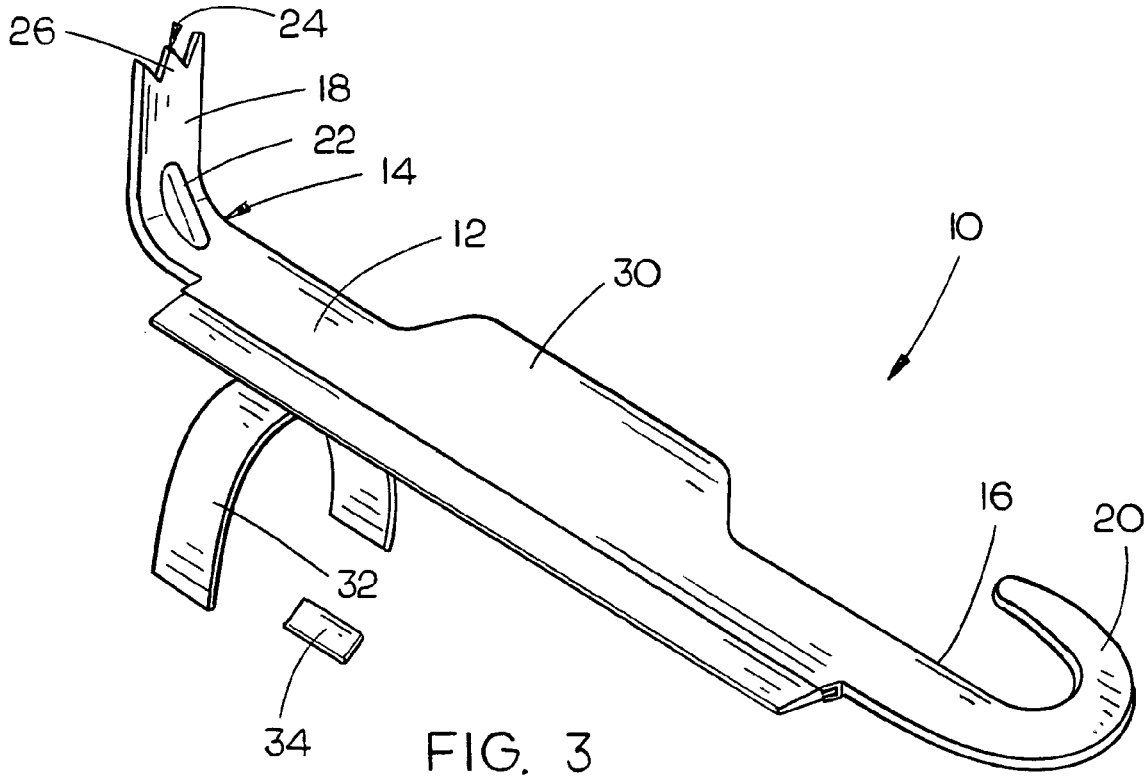
FIG. 3 is an isometric view of one embodiment of the tool of the present invention.

In another preferred embodiment, the tool 10 is provided with an elongated blade 28 that extends outwardly from, and along a length of, the body 12 as depicted in FIG. 3. It is preferred that the blade 28 be comprised of a deformably resilient material, such as natural or synthetic rubber compounds, various blends of plastics, closed cell foam products, and the like. The blade 28 may be integrally formed with the tool 10 or may be removably or permanently coupled thereto. Various adhesives, fasteners and the like will suffice for permanently coupling the blade 28 to the tool 10. Other structures, such as the shaped slot and tab system depicted in FIG. 3, removable pins and such, are contemplated where a releasable engagement is desired. When the blade 28 is releasably coupled with the tool 10, replacement blades may be used to extend the life of the tool 10. In use, the user simply grasps the body 12 and engages the blade 28 with any surface on the golf cart that is wet or covered in debris. The user then simply manipulates the tool 10 across the surface so that the fluid or debris is substantially removed. This will be beneficial where a cleaning solution is applied to various surfaces, such as the windshield 111, the seat 102, or the body panels, such as the hood 112, in order to remove any dirt or other debris such that a spot or streak-free appearance is provided. The blade 28 will provide a fast and easy way of "drying" golf cart surfaces that have been hosed down at the end of an overall cleaning process.

For the uses of the tool 10 that require the user to grasp the body 12, it may be preferable to provide a handle or extension 30 that extends outwardly from the body 12, as depicted in FIG. 3. It will be preferred that the extension be sized and shaped to comfortably fit a portion of the user's hand. Just as importantly, however, the size and shape of the extension 30 should be such that the user is provided with increased leverage for manipulating the tool 10.

Figure 4:
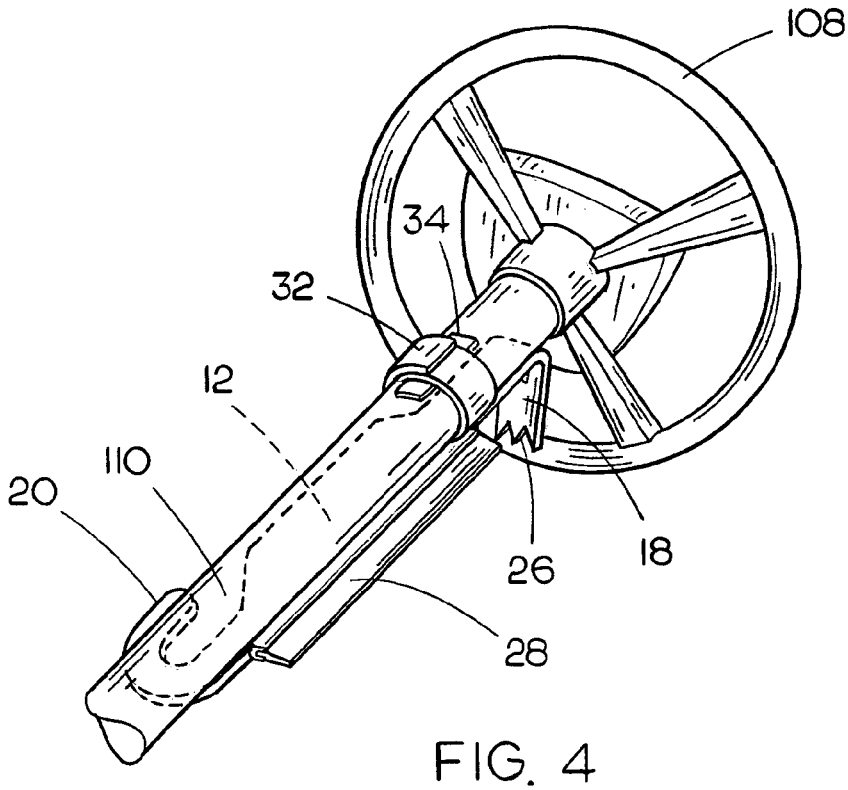
FIG. 4 is an isometric view of the tool depicted in FIG. 3 as the same could be stored against the steering column of a golf cart.

In another preferred embodiment, a means for releasably securing the body 12 to a portion of the golf cart 100 is provided so that the tool 10 may be stored in a position that is conveniently accessible by the user. In one embodiment, the means may be provided by an elongated flexible strap 32 having opposite end portions. The opposite ends of the strap may be secured around a structural member, such as the steering column 110 and then secured to one another. Fasteners, such as a hook-and-loop fastener, snaps, buttons, and the like may be used. A bracket or spring clip may also be provided to releasably engage a frame member or the steering column 110. Means such as the strap 32, flexible cords, and such, may be preferred due to their ability to accommodate varying diameters of structural members to which one might want to secure the tool 10. FIG. 4 depicts one manner in which the tool 10 may be secured to a steering column 110. The orientation of the tool 10 when it is in its storage position may vary according to the circumstances at hand. For example, it is contemplated that one may want to orient the tool 10 so that the arm member 18 is directed away from locations that may casually come into contact with a golfer's legs and arms. Additional fastening strips 32 may be provided for additional securement or to work in conjunction with the strap 32, as depicted in FIG. 4. The additional fastening strips 34 may be a part of a hook-and-loop fastener or may simply be an adhesive or magnetic member. Certainly, more than one fastening means is contemplated along the length of the body 12. Regardless of the number of fastening means used, common fastening methods should be used to secure the means to the tool 10, including structural fasteners, adhesives, etc.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A tool for use with a golf cart, having a steering wheel and a seat that covers an engine compartment, the tool comprising:

an elongated body having opposite first and second end portions;

an arm member extending in a generally perpendicular manner from the first end portion of said body;

means for releasably securing the second end portion of said body to a portion of the steering wheel; and an elongated blade that extends from and along a length of said body; said blade being comprised of a flexible and resilient material.

2. The tool of claim 1 wherein said means is comprised of a generally hook-shaped arm that extends from the second end portion of said body.

3. The tool of claim 2 wherein said hook-shaped arm is shaped and sized to releasably engage a generally curved surface of the steering wheel.

4. The tool of claim 1 wherein said arm member deviates slightly from perpendicular at an acute angle with respect to said body.

5. The tool of claim 1 wherein said arm member deviates slightly from perpendicular at an obtuse angle with respect to said body.

6. The tool of claim 1 wherein said arm member is provided with generally pointed projections that extend from a distal end of said arm member.

7. The tool of claim 6 wherein said means is comprised of a generally hook-shaped arm that extends from the second end portion of said body.

8. The tool of claim 1 comprising securement means for releasably securing said body to a steering column that extends from said steering wheel.

9. The tool of claim 8 wherein said securement means is comprised of a flexible strap, having opposite end portions, that is coupled with said steering column.

10. The tool of claim 9 wherein a hook-and-loop style of fastener is provided to the opposite end portions of said flexible strap so that said flexible strap may be adjustably secured around steering columns having different circumferences.

11. The tool of claim 1 wherein said blade is comprised of a natural or synthetic rubber material.

12. A method of preparing equipment, the method comprising the steps of:

providing a golf cart having a steering wheel and a seat which covers an engine compartment and may be moved at least temporarily between open and closed positions;

providing a tool comprising: an elongated body having opposite first and second end portions; an arm member extending in a generally perpendicular manner from the first end portion of said body; and means for releasably securing the second end portion of said body to a portion of the steering wheel;

moving the golf cart seat to an open position with respect to the engine compartment;

releasably engaging said arm member with a rearward edge portion of the golf cart seat; and releasably engaging said means with a portion of the steering wheel so that the golf cart seat is secured in said open position.

13. A method according to claim 12, further comprising the steps of:

providing said tool with pointed projections that extend from a distal end of said arm member;

grasping said body; and repeatedly engaging said pointed projections with debris covering at least a portion of a sole on a golf shoe so that debris is substantially removed from the sole.

14. The method according to claim 12, further comprising the steps of:

providing said tool with securement means for releasably securing said body to a steering column that extends from said steering wheel positioning said body adjacent said steering column; and engaging said securement means with said steering column so that the tool is releasably secured to said steering column in a storage position.

15. A method of removing liquid from a surface on a golf cart, the method comprising the steps of:

providing a tool comprising: an elongated body having opposite first and second end portions; an arm member extending in a generally perpendicular manner from the first end portion of said body; and means for releasably securing the second end portion of said body to a portion of a steering wheel on the golf cart; and an elongated blade that extends from and along a length of said body; said blade being comprised of a flexible and resilient material;

grasping said body;

engaging an elongated edge portion of said blade with a wet surface on the golf cart; and manipulating the tool across said wet surface so that said wet surface is substantially dried.

16. The method of claim 15 further comprising the step of wetting said surface with a cleaning solution to make said surface wet, prior to the step of manipulating the tool across said wet surface.

* * * * *